US006447336B1

(12) United States Patent
Fannin et al.

(10) Patent No.: US 6,447,336 B1
(45) Date of Patent: Sep. 10, 2002

(54) PASSAGE SEALING ELECTRICAL CONNECTOR FOR A MOTORIZED CONVEYOR PULLEY

(75) Inventors: Daniel G. Fannin, West Union, OH (US); Ryan Boucher, Davisburg, MI (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 09/538,760

(22) Filed: Mar. 30, 2000

(51) Int. Cl.[7] ..... H01R 13/40
(52) U.S. Cl. ..... 439/587
(58) Field of Search ..... 198/936, 788, 198/819, 835, 307.1; 210/222; 324/173; 439/587

(56) References Cited

U.S. PATENT DOCUMENTS 4,082,180 A 4/1978 Chung
4,584,433 A 4/1986 Bowsky et al.
5,017,740 A 5/1991 Honkomp et al.
5,022,513 A 6/1991 Huber
5,129,843 A 7/1992 Bowsky et al.
5,131,858 A 7/1992 Heimbrock
5,180,344 A 1/1993 Hall
5,451,169 A * 9/1995 Corbett, III et al. ..... 439/936
5,918,728 A 7/1999 Syverson
6,117,318 A * 9/2000 Simonelli ..... 210/222

* cited by examiner

*Primary Examiner*—P. Austin Bradley
*Assistant Examiner*—Edwin A. León
(74) *Attorney, Agent, or Firm*—Harness, Dickey & Pierce, P.L.C.

(57) ABSTRACT

The present invention provides an electrical connector for a motorized conveyor pulley which has a plate having a first side and a second side and an outer surface. The plate is preferably constructed of an insulating glass material. At least one electrical connector is supplied which provides electrical communication from the first side to the second side. The plate is formed around the electrical connector to fluidly seal the first side from the second side. In another aspect of the present invention, the electrical connector has an outer shell structure having an internal area and an outer area. A portion of the internal area encapsulates and is bonded to the outer surface of the plate.

20 Claims, 3 Drawing Sheets

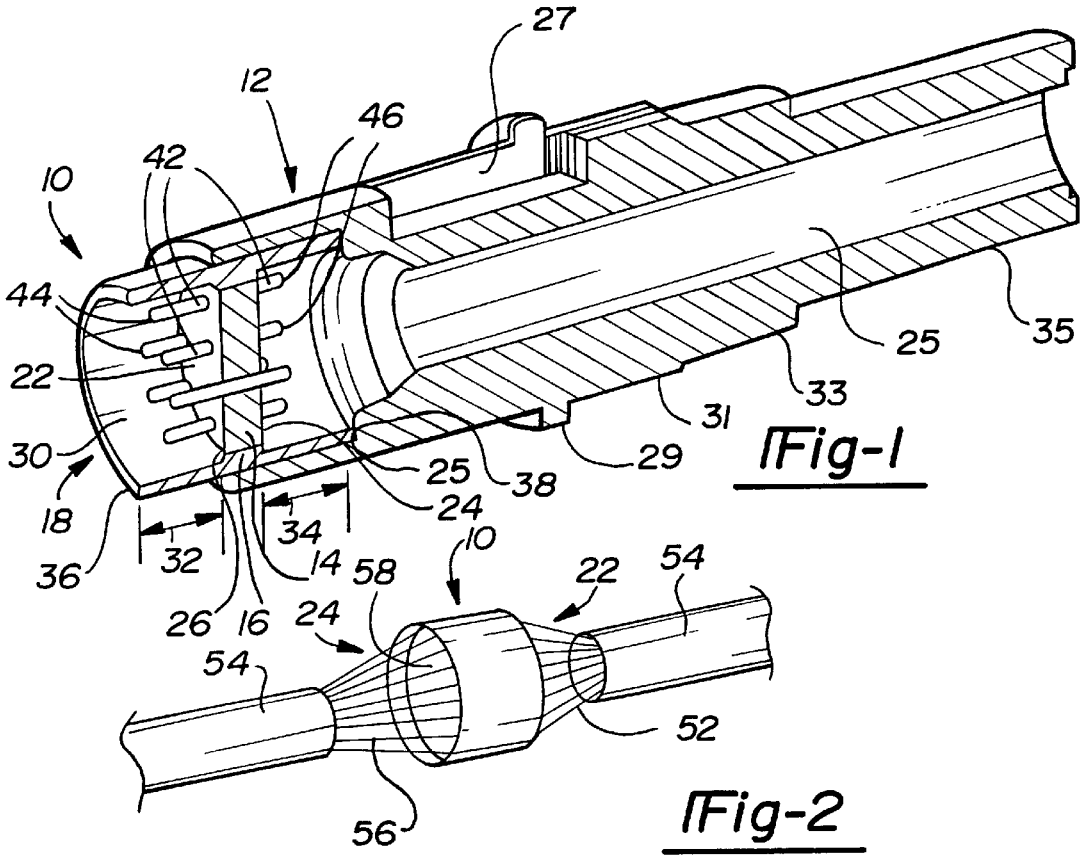
Fig-1
Fig-2
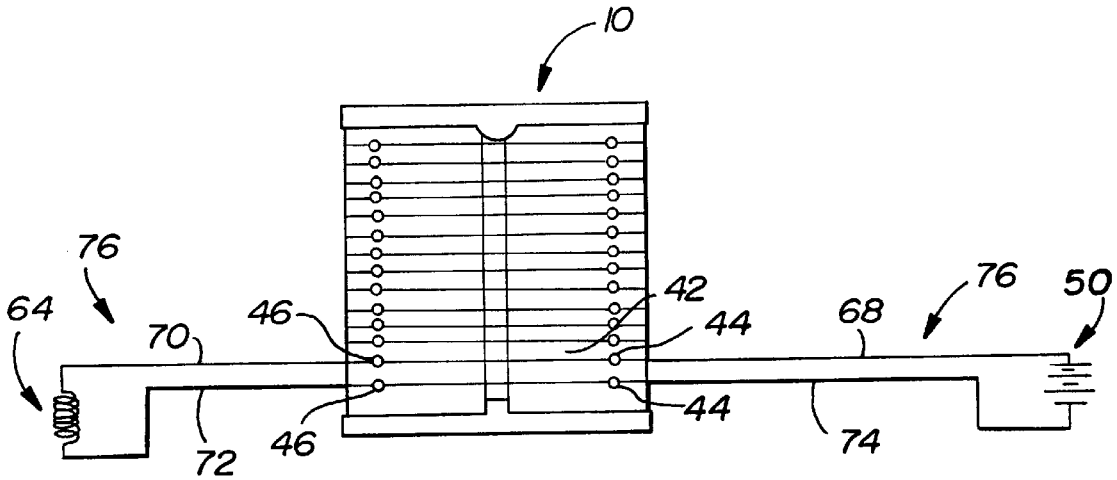
Fig-3

PASSAGE SEALING ELECTRICAL CONNECTOR FOR A MOTORIZED CONVEYOR PULLEY

BACKGROUND OF THE INVENTION

I. Technical Field

The present invention relates generally to an electrical connector for a motorized conveyor pulley and, more particularly, to an electrical connector for a motorized conveyor pulley which effectively fluidly seals a passage in which the electrical connector is positioned.

II. Discussion

Conventional mechanical technology many times requires electrical power to be supplied into an environment containing lubricants or other fluids. Specific devices which require such a power supply include motorized conveyor pulleys. For instance, electric motors for motorized conveyor pulley systems generally comprise operational parts and lubricant which together with the motor are completely enclosed within the pulley housing. However, for operation, the motor must be provided with electrical energy. In addition, the specific application of motorized conveyor pulleys require the pulley housing to selectively be supplied with power for operating various electrical devices such as braking systems disposed therein. To accomplish these functions, a shaft and an electrical cable must be provided which penetrates the pulley housing. The shaft is typically fitted with a passage through which an electrical cable having a plurality of conductors is passed to supply the motor and associated devices with electrical power.

While the motorized conveyor pulley housing effectively allows ingress and egress of the proper mechanical and electrical components, lubricant tends to leak through the passage in the shaft around the cable through which electrical power is supplied. The present invention was developed to overcome this problem.

SUMMARY OF THE INVENTION

It is therefore an object of the present invention to provide an electrical connector located in a passage of a motorized conveyor pulley shaft that provides a conduit for electrical wiring and seals the passage to thereby prevent leakage of lubricant therethrough.

To accomplish these and other objects, the present invention provides an electrical connector for a motorized conveyor pulley having a plate with a first side, second side, and an outer surface. The plate is constructed of an insulating glass material. At least one conductor pin is supplied which provides electrical communication from the first side to the second side. The plate is formed around the conductor pin to fluidly seal the first side from the second side. The electrical connector has an outer shell structure having an internal area and an outer area. A portion of the internal area surrounds and is bonded to the outer surface of the plate.

Further areas of applicability of the present invention will become apparent from the detailed description provided hereinafter. It should be understood that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

In the drawings which illustrate the best mode presently contemplated for carrying out the present invention:

FIG. 1 is a sectional view of an electrical connector shown in assembled relationship with a shaft according to the present invention;

FIG. 2 is a diagrammatical perspective view of an electrical connector according to the present invention with electrical cables to be connected thereto;

FIG. 3 is a schematic view of an electrical connector according to the present invention;

DETAILED DESCRIPTION OF THE PREFERRED EMBODIMENTS

Figure 4:
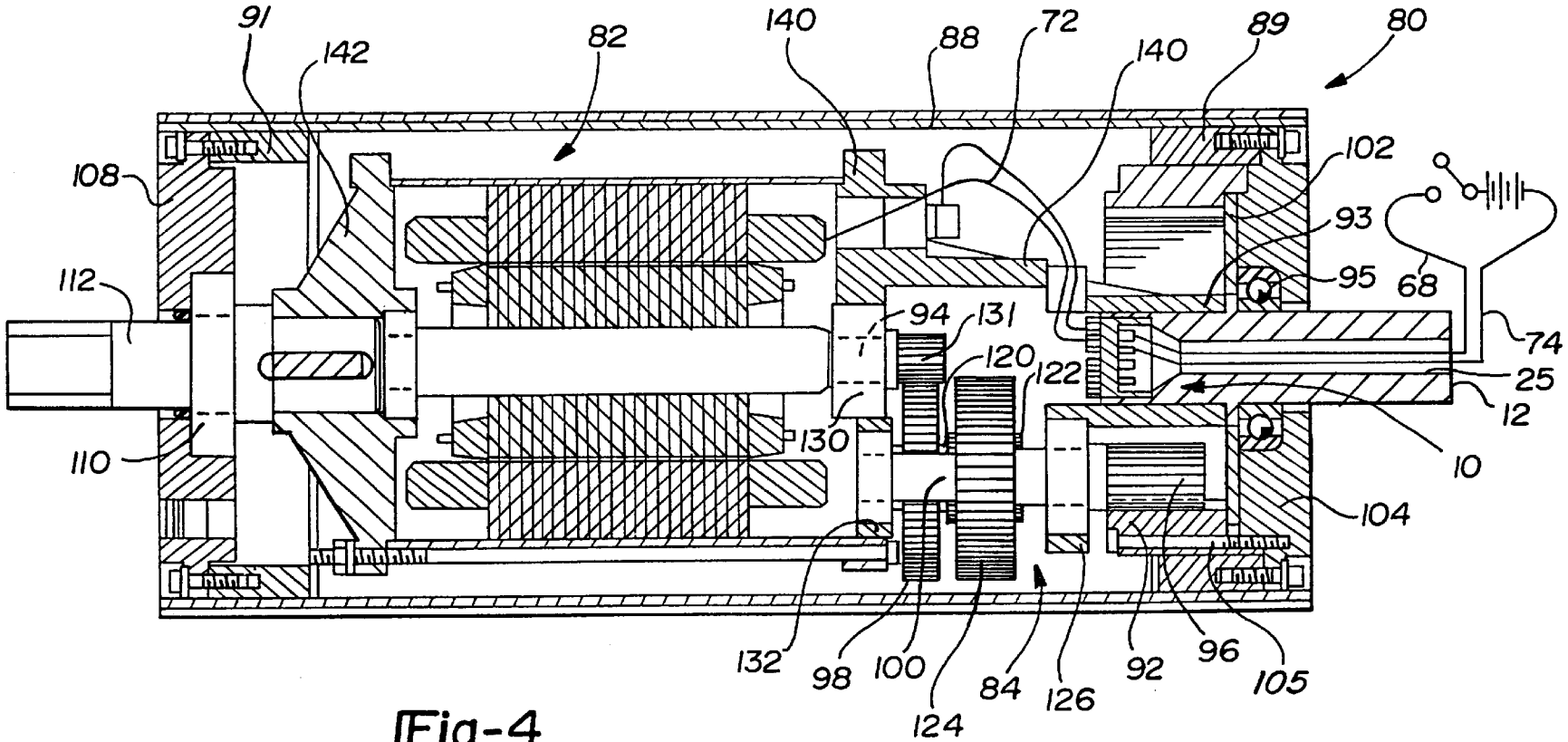
FIG. 4 is a cross-sectional view of an electrical connector shown in assembled relationship with a motorized conveyor pulley according to the present invention.

The following description of the preferred embodiments is merely exemplary in nature and is in no way intended to limit the invention, its application, or uses.

Referring now to FIG. 1, a sectional view of an electrical connector 10 is shown positioned in a shaft 12. An electrical connector 10 generally comprises plate 14 mounted to raised lip 16 of an outer shell 18. Plate 14 has a first side 22, which is exposed to an internal (See FIG. 4) environment (as will be discussed), and a second side 24 which is exposed to an external environment via an extended passage 25 in shaft 12. Plate 14 also has an outer surface 26 which is mated to raise lip 16. Glue, epoxy, or other suitable bonding arrangements, or any other suitable method can be used to attach these surfaces which ensures a fluid tight seal between outer surface 26 and raised lip 16.

Outer shell 18 is preferably constructed of metal and is cylindrical in shape. Outer shell 18 extends a first predetermined distance 32 from first side 22 of plate 14 and extends a second predetermined distance 34 from second side 24. At opposite ends of this extension, outer shell 18 terminates at first rim area 36 and second rim area 38. Outer shell 18 acts as a mounting member to mount plate 14 to the inner diameter of shaft 12 (as will be discussed). This mounting is preferably a press fit of outer shell 18 into shaft 12. However, since outer shell 18 serves merely as a mount, other mounting shells or, in fact, no mounting shell at all can be used to secure plate 14 within a passage in shaft 12, provided that the outer surface of plate 14 sealably engages the walls of the passage in shaft 12 in fluid tight sealing relationship.

A plurality of conductor pins 42 extend through plate 14 to provide electrical communication therethrough. Preferably, these conductor pins 42 are positioned in spaced relationship and extend through plate 14, and outwardly from first side 22 and second side 24, terminating at first end 44 and second end 46 respectively. Preferably, first end 44 and second end 46 are distanced less than first predetermined distance 32 and second predetermined distance 34 from their respective sides. This distancing ensures that first end 44 and second end 46 fall below first rim area 36 and second rim area 38 so as to facilitate encapsulation thereof in a non-conductive potting agent as will be discussed.

Plate 14 is constructed from E-glass, ceramic or other material which may be solidified around pins 42. However, this material must have a high dielectric and mechanical strength so as to prevent shorting of the pins as well as to ensure they are mechanically supported. The formability of the material used to construct plate 14 ensures that an accurate and fixed fluid tight fit exists between the electrically conductive pins 42 and plate 14. As will be further discussed, this fit ensures that lubricants contained within the internal environment of the pulley housing 12 do not leak to the external environment.

Shaft 12 is generally cylindrical in nature with a counter bore at one end adapted to accept electrical connector 10. The counter bore ends at end 25. Preferably, the diameter of the counter bore is slightly smaller than the outer diameter of electrical connector 10 to allow a press fit therebetween. End 25 is set in shaft 12 deep enough to allow first predetermined distance 32 to extend outward from shaft 12. On an external area of shaft 12 is contained key slot 27, ridge 29, and steps 31, 33, and 35 (for reasons which will be discussed).

Referring now to FIGS. 2 and 3, the operation of the present invention will be described. In FIG. 2, a first plurality of wires 52 extending from apparatus within the conveyor pulley is shown encased in casing 54. From an edge of casing 54, wires 52 lead up and connect to first end 44 of pins 42 extending from first side 22 of electrical connector 10. A second plurality of wires 56 exits second side 24 and enters casing 54. These wires are then carried to an electrical supply (as will be discussed) for providing power to the motorized conveyor pulley.

Figure 6:
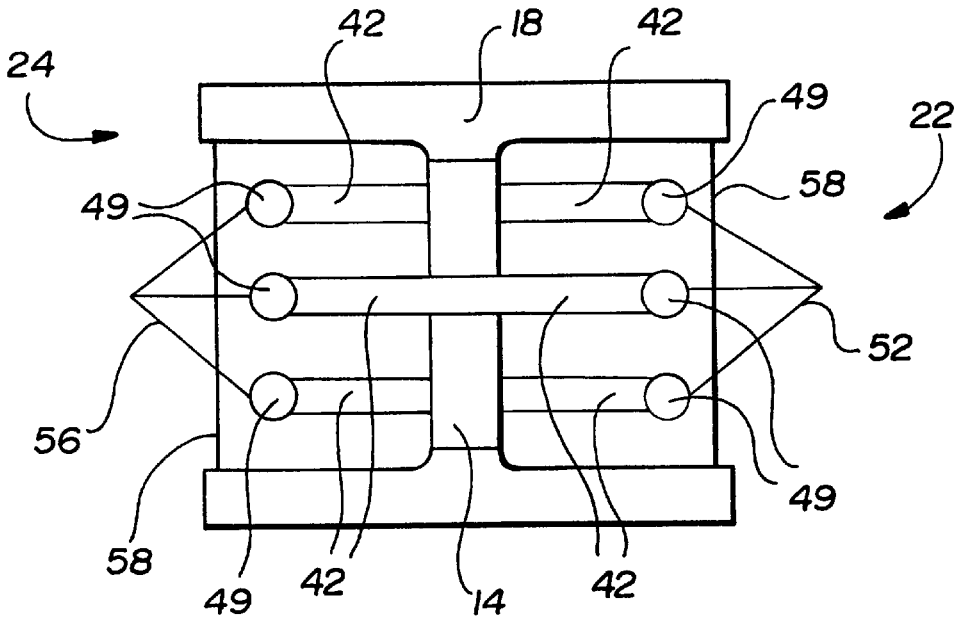
FIG. 6 is a cross sectional view of an electrical connector according to the present invention shown in an operative installation.

With respect to FIGS. 2 and 6, proper connection of wires 52 and 56 to their respective pins 42 is illustrated. Here, a non-conductive potting agent 58 is provided which ensures that each portion of pin 42 extending from plate 14 does not short. The non-conductive potting agent is potted around pins 42 in the cavity formed by second side 24 and outer shell 18. Non-conductive potting agent 58 is produced as non-conductive clay-like material which can be shaped around objects and acts to insulate the space existing between each respective pin extending from first side 22 and second side 24. Each wire 56 and 52 is connected to pin 42 by solder 49. Solder 49, in conjunction with potting agent 58 acts to secure wires 56 and 52 to pins 42.

FIG. 3 illustrates electrical connector 10 being used in conjunction with a power source 50 and electrical device 64. Power source 50 attaches, by positive lead 68, to a second end 46 of a pin 42. First end 44 of the pin 42 attaches to lead 70, thereby supplying electrical power to electrical device 64 through the pin 42. For grounding, electrical device 64 is connected to first end 44 of another pin 42 by lead 72. This ground is completed by lead 74 connecting the ground of power source 50 to second end 46. This series of electrical connections completes a circuit hereinafter referred to as a conductive loop 76.

It is noted that for clarity purposes, the depiction in FIG. 3 illustrates only one conductive loop utilizing two pins 42. Although not illustrated, the remaining pins 42 are used in a similar fashion by power source 50 to power other electrical devices not shown. Power source 50 can use a multiplexor, banks of switches, or other known means which are well known in the art for energizing a subset of a plurality of electrical circuits to accomplish this task.

Referring now to FIG. 4, electrical connector 10 is shown positioned in passage 25 of shaft 12 of motorized conveyor pulley 80. Preferably, electrical connector 10 is press fit on the internal bore of passage 25. To support shaft 12, the external area of shaft 12 contains key slot 27, ridge 29 and steps 31, 33 and 35. Slot 25 provides a placement for key stock to ensure that shaft 12 does not rotate with respect to sleeve 93. Ridge 29 sits within a corresponding groove to ensure that shaft 12 does not move laterally with respect to motorized conveyor pulley 80. Step 31 supports bearing 95, which allows outer plate 104 to rotate with respect to shaft 12. Steps 33 and 35 support sleeves and retainers respectively which maintain shaft 12 in a sealed engagement with motorized conveyor pulley 80.

Motorized conveyor pulley 80 contains a rotor stator assembly 82 which provides rotational energy to ring gear 92 by gear train 84. Gear train 84 generally includes a rotor shaft 94 supported by a bearing 130. On the opposing side of bearing 130 with respect to rotor stator assembly 82 is gear 131 which is meshed with a driver gear 98. Driver gear 98 is attached to shaft 120 which sits behind shaft 100 in FIG. 4. Shaft 120 is, in turn, engaged to pinion gear 122 which meshes with gear 124. Gear 124 is engaged to shaft 100 which is supported by bearings 126 and 132. Rotation of gear 124 causes rotation of shaft 100 and subsequently pinion gear 96 which is splined to shaft 100. Pinion gear 96 then meshes with internal teeth provided on ring gear 92. Ring gear 92 is in turn secured to outer plate 104 via mounting plate 102 by a plurality of fasteners 105.

Shaft 12 is press fit into support sleeve 93. Support sleeve 93 is attached to a network of internal frame work, such as frame components 140, which support items such as bearings 130, 132 and 126 as well as the stator for rotor stator assembly 82. Likewise, second shaft 112 is positioned within end plate 142 to keep similar components affixed to second shaft 112. As a result, the internal components of motorized conveyor pulley 80 are unable to rotate about shaft 12 or second shaft 112. As such, actuation of the rotor stator assembly 82 results in rotation of outer shell 88 about shaft 12 and second shaft 112.

A housing is provided for encasing the internal components of motorized conveyor pulley 80 as well as providing a rotatable member for driving a belt (as will be discussed). Such internal components include, but are not limited to, gear train 84 and rotor stator assembly 82. The internal components are protected from the external environment surrounding the motorized conveyor pulley 80 which can be harsh due to the severe conditions existing in manufacturing facilities which may use the present invention. The housing generally comprises outer tube 88, outer plate 104, and second outer plate 108. Outer plate 104 is attached to an outer ring 89 secured to outer tube 88 by a plurality of bolts. Likewise, second outer plate 108 is attached to outer tube 88 at an outer diameter of outer plate 108 by a second plurality of bolts and outer ring 91. Finally, second outer plate 108 and outer plate 104 are rotatably supported on second shaft 112 and shaft 12 respectively. Second outer plate 108 is supported by bearing 110 while outer plate 104 is supported by bearing 95. Bearings 110 and 95 allow outer tube 88 to rotate with respect to second shaft 112 and shaft 12.

Figure 5:
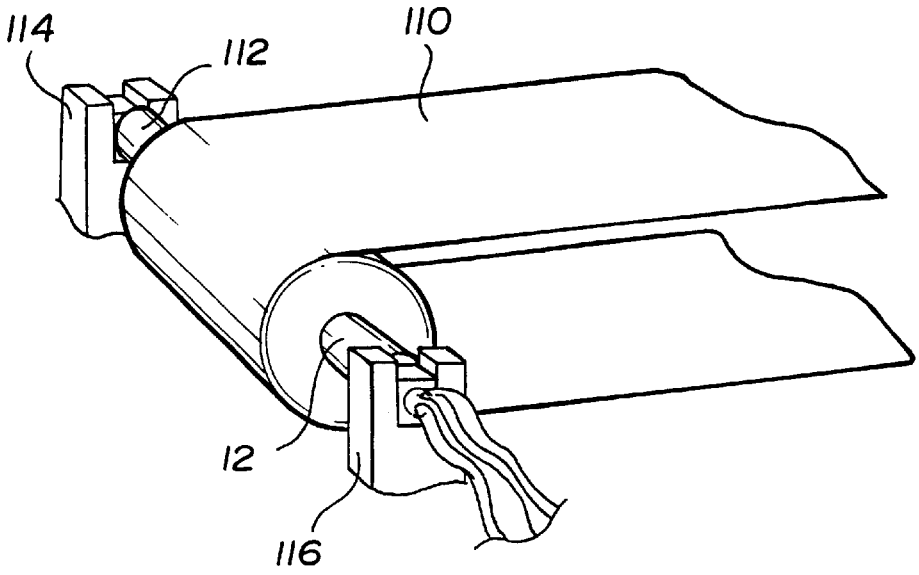
FIG. 5 is an environmental view of an electrical connector and motorized conveyor pulley according to the present invention shown in an operative installation.

In operation, rotor stator assembly actuates rotor shaft 94 which causes rotational energy to be transferred through gear train 84. Ring gear 92 of gear train 84, in turn, transfers this energy through mounting plate 102 to outer plate 104. Because of the attachment of outer tube 88 to outer plate 104 and second outer plate 108, outer tube 88 is able to be rotationally driven by outer plate 104 about shaft 12 and second shaft 112. As shown in FIG. 5, shaft 12 and second shaft 112 are rotationally restricted by supports 116 and 114 respectively. As such, the rotational energy provided by outer tube 88 is transmitted to an outer component such as belt 110.

Rotor stator assembly 82 is actuated by closing switch 86, thereby completing conductive loop 76 (see FIG. 3).

Because electrical connector 10 is sealingly secured within passage 25, lubricant and other fluids contained within outer tube 88 are unable to pass through electrical connector 10 and leak out passage 25 of shaft 12. Moreover, alternate conductive loops can be actuated to actuate other elements within motorized conveyor pulley 80 such as brake elements.

The invention being thus described, it will be obvious that the same may be varied in many ways. Such variations are not to be regarded as a departure from the spirit and scope of the invention. Such variations or modifications, as would be obvious to one skilled in the art, are intended to be included within the scope of the following claims.

What is claimed is:

1. A motorized conveyor pulley comprising:

a housing defining an internal environment;

a motor contained within said housing, said motor operationally engaged with said housing to rotatably drive said housing;

at least one shaft rotatably supporting said housing, said shaft having a passage for supplying power from an external environment to said internal environment; and an electrical connector positioned within said passage, said electrical connector providing electrical communication into said internal environment and at least said motor, said electrical connector sealing said passage from fluidly communicating said internal environment with said external environment.

2. A motorized conveyor pulley as claimed in claim 1, wherein said electrical connector further comprises:

a plate having a first side and a second side and an outer surface, said plate being constructed of an insulating material;

at least one conductor providing electrical communication from said first side to said second side, said plate formed around said conductor to fluidly seal said first side from said second side.

3. A motorized conveyor pulley as claimed in claim 2 wherein said electrical conductor further includes an outer shell structure having an internal area and an outer area, a portion of said internal area encapsulating and bonded to said outer surface of said plate, said outer area sealingly secured to an internal diameter of said passage.

4. A motorized conveyor pulley as claimed in claim 3 wherein said shell structure extends a first predetermined length away from one of said first and second sides of said plate and cooperating with said plate to define a cavity, and a non-conductive potting agent positioned within said cavity.

5. A motorized conveyor pulley as claimed in claim 4 wherein said electrical connector further includes one or more electrically conductive pins extending through said plate and first and second wires connected to opposite ends of said one or more electrically conductive pins.

6. A motorized conveyor pulley as claimed in claim 3, wherein said shell structure extends a first predetermined length away from said first side of said plate and terminates at a first rim area, said shell structure extends a second predetermined length away from said second side of said plate and terminates at a second rim area, whereby a first cavity is defined by said shell structure and said first side of said plate and a second cavity is defined by said shell structure and said second side of said plate.

7. A motorized conveyor pulley as claimed in claim 6, wherein said at least one connection is a pin connector, said pin connector extending less than or equal to said first predetermined length away from said first side of said plate and extending less than or equal to said second predetermined length away from said second side of said plate.

8. An electrical connector as claimed in claim 7, wherein said outer surface of said plate and said outer shell structure are cylindrical in shape.

9. An electrical connector as claimed in claim 6, wherein said electrical connector comprises a plurality of pin connectors, said plurality of pin connectors passing through said plate and extending said first predetermined distance away from said first side of said plate and terminating at a first end, said plurality of pin connectors extending said second predetermined distance away from said second side of said plate and terminating as a second end.

10. An electrical connector as claimed in claim 9, further comprising a non-conductive potting agent positioned in said first cavity and said second cavity, said potting agent filling said first cavity to said first rim area and filling said second cavity to said second rim area, whereby said potting agent prevents said pin connectors from arcing.

11. An electrical connector as claimed in claim 9, wherein said plurality of pin connectors comprises a member of the set consisting of twelve and fourteen pin connectors.

12. A motorized conveyor pulley having an electrical connector which provides electrical power while fluidly sealing said motorized conveyor pulley, said motorized conveyor pulley comprising:

a housing defining an internal environment which encapsulates internal components;

a motor contained within said housing, said motor operationally engaged with said housing to rotataby drive said housing;

a shaft and a second shaft rotatably supporting said housing, said shaft having a passage connecting an external environment and said internal environment;

an electrical connector positioned within said passage, said electrical connector comprising:

a disc shaped plate having a first side and a second side and an outer surface, said plate being constructed of an electrically insulating material;

a plurality of connections providing electrical communication from said first side to said second side, said plate formed around said electrical connector to fluidly seal said first side from said second side;

an outer shell structure having an internal area and an outer area, a portion of said internal area encapsulating and bonded to said outer surface of said plate, said outer area engaged to an internal diameter of said passage, said shell structure extends a first predetermined length away from said first side of said plate and terminates at a first rim area, said shell structure extends a second predetermined length away from said second side of said plate and terminates at a second rim area, whereby a first cavity is defined by said shell structure and said first side of said plate and a second cavity is defined by said shell structure and said second side of said plate.

13. A motorized conveyor pulley as claimed in claim 12, wherein said plurality of connections comprises a plurality of pin connectors, each of said pin connectors extending a distance of less than or equal to said first predetermined length from said first face of said disc shaped plate and terminating at a first end, each of said pin connectors extending a distance of less than or equal to said second predetermined length from said second face of said disc shaped plate and terminating at a second end, whereby said pin connectors do not extend beyond said first rim area and said second rim area.

14. An electrical connector as claimed in claim 13, further comprising a first plurality of wires and a second plurality of wires, each of said first plurality of wires attached to a respective first end of each of said plurality of pin connectors, each of said second plurality of wires attached to a respective second end of each of said second plurality of pin connectors.

15. An electrical connector as claimed in claim 14, wherein said plurality of pin connectors, said first plurality of wires and said second plurality of wires forms a plurality of conductive loops.

16. An electrical connector as claimed in claim 15, further comprising a plurality of electrical devices, each said electrical devices in electrical communication with a pair of said second plurality of wires such that each electrical device is powered by a respective conductive loop.

17. An electrical connector as claimed in claim 15, wherein each said electrical device is located internal to said motorized conveyor pulley.

18. A motorized conveyor pulley comprising:

a cylindrical housing for engaging a conveyor belt, said housing defining an internal environment containing internal components of said motorized conveyor pulley, said housing having an end plate and a second end plate attached to respective opposing ends of said outer tube;

a motor contained within said housing, said motor operationally engaged with said housing through a gear train to rotatably drive said housing;

a first shaft and a second shaft, rotatably supporting said housing, said first shaft having a passage connecting an external environment and said internal environment, said first shaft rotatably supporting said end plate, said second shaft rotatably supporting said second end plate; and an electrical connector positioned within said passage, said electrical connector providing electrical communication into said internal environment and at least said motor, said electrical connector sealing said passage from fluidly communicating said internal environment with said external environment.

19. A motorized conveyor pulley as claimed in claim 18, wherein said electrical connector further comprises:

a plate having a first side and a second side and an outer surface, said plate being constructed of an insulating glass material;

at least one connection providing electrical communication from said first side to said second side, said plate formed around said connection to fluidly seal said first side from said second side; and an outer shell structure having an internal area and an outer area, a portion of said internal area encapsulating and bonded to said outer surface of said plate, said outer area sealingly secured to an internal diameter of said passage.

20. A motorized conveyor pulley comprising:

a housing;

a first shaft and a second shaft rotatably supporting said housing, said first shaft having a passage extending between a first end and a second end, said second end positioned internal to said housing;

electrical leads extending through said passage; and a connector positioned within said passage for connecting said electrical leads from said first end of said shaft to said second end of said shaft, said connector sealing said passage to prevent fluid flow therethrough.

* * * * *